US009014389B2

(12) United States Patent
Dooley et al.

(10) Patent No.: US 9,014,389 B2
(45) Date of Patent: Apr. 21, 2015

(54) MEGAPHONE

(71) Applicants: Thomas Dooley, Hoboken, NJ (US); Mathieu Zastawny, Philadelphia, PA (US)

(72) Inventors: Thomas Dooley, Hoboken, NJ (US); Mathieu Zastawny, Philadelphia, PA (US)

(73) Assignee: Nielsen-Kellerman Co., Boothwyn, PA (US)

( * ) Notice: Subject to any disclaimer, the term of this patent is extended or adjusted under 35 U.S.C. 154(b) by 281 days.

(21) Appl. No.: 13/801,621

(22) Filed: Mar. 13, 2013

(65) Prior Publication Data

US 2014/0029760 A1 Jan. 30, 2014

Related U.S. Application Data

(60) Provisional application No. 61/675,612, filed on Jul. 25, 2012.

(51) Int. Cl.
*H04R 27/04* (2006.01)
*H04R 1/02* (2006.01)

(52) U.S. Cl.
CPC . *H04R 1/02* (2013.01); *H04R 27/04* (2013.01)

(58) Field of Classification Search
CPC ..... H04R 1/02; H04R 27/04; H04R 27/00; H04R 1/30; A42B 3/30; A42B 3/0406
USPC ..... 381/75
See application file for complete search history.

(56) References Cited

U.S. PATENT DOCUMENTS 3,412,207 A * 11/1968 Sugawara ..... 381/75
4,236,195 A * 11/1980 Kovacik ..... 362/376
5,050,055 A * 9/1991 Lindsay et al. ..... 362/293
5,267,131 A * 11/1993 Anthony et al. ..... 362/208
5,695,278 A * 12/1997 Grossman et al. ..... 362/374

OTHER PUBLICATIONS

Califone, "Megaphone model P8A Specification—Jan. 2010".*
Califone, "Megaphone model PA20A specification—Jan. 2010".*

* cited by examiner

*Primary Examiner* — Vivian Chin
*Assistant Examiner* — David Ton
(74) *Attorney, Agent, or Firm* — Cozen O'Connor

(57) ABSTRACT

A rugged megaphone comprising a body, two opposing handles and a horn and further comprising a rim bumper attached to the tip of the horn; providing a megaphone of superior durability.

14 Claims, 7 Drawing Sheets

MEGAPHONE

CROSS-REFERENCE TO RELATED APPLICATIONS

This application claims priority to U.S. provisional application No. 61/675,612 filed Jul. 25, 2012, which is incorporated herein by reference in its entirety.

FIELD OF INVENTION

The present application is generally related to a portable device for the amplification of sounds, typically referred to as a megaphone or loudspeaker, where the megaphone comprises a top and bottom handle that attach from the body of the megaphone to the front of the bell providing a megaphone with superior durability.

BACKGROUND OF THE INVENTION

There are numerous known examples of a loudspeaker or megaphone, collectively "megaphone," which typically comprise a microphone, an amplifier, a handle, a speaker, and a bell surrounding the speaker to provide directional amplification of sound through the microphone. Typically, these megaphones are held by a user and comprise a trigger below the bell, to turn on and off the microphone, allowing selective amplification of sounds.

These devices are often used in situations where there is a need to amplify the voice of a speaker. One such occurrence is on an athletic field, where a single person provides instruction to participants situated through the athletic field. When not in use, the megaphone is often carried over the shoulder, or is frequently placed on the ground or in a carrying device where the megaphone is susceptible to impact resulting in breakage of the megaphone, typically the handle, body, or the bell. Such typical use frequently results in breakage of the megaphone.

U.S. Pat. No. 2,692,913 to Katnimori and U.S. Pat. No. 2,808,458 to Turpin and Leger, which are incorporated by reference herein in their entirety, identify a typical electronic megaphone allowing amplification of voice. These inventions, however, are susceptible to damage, in particular to the bell or the handle through typical use.

There is a need for a new rugged portable megaphone that facilitates the amplification of sound while comprising a rugged structure.

SUMMARY OF THE INVENTION

A new and improved megaphone comprising a body, a grip and a horn; wherein said grip extends from the bottom of the body, and the horn is attached to one end of the body; a rugged casing comprising a body handle, a top handle, a bottom handle, and a rim bumper; wherein the body handle surrounds the body of the megaphone and the rim bumper attaches to the tip of the horn; wherein the top handle is situated on the top of the megaphone and connects from the body handle to the rim bumper and wherein the bottom handle is situated on the bottom of the body, connecting from the bottom of the grip to the rim bumper.

An additional embodiment of the invention is a megaphone covering kit comprising a bumper selected to fit over the body of the megaphone, a left structure and a right structure; said left and right structures being a complementary pair, with each structure comprising a top and a bottom handle, a body handle, and a rim bumper; said left and right structures being of such fit to securely attach to the outer rim of the horn, the handle, and the body of the megaphone.

An additional embodiment of the invention is a megaphone comprising a body, a horn secured to one end of said body, a microphone secured to the other end of said body, an amplifier situated within the body of the megaphone capable of amplifying sound waves directed at the microphone, a battery secured to the microphone end of the body to power the microphone and amplifier, a power switch and a trigger, wherein the power switch can turn the megaphone on or off, and the trigger can activate the microphone when the megaphone is turned on, and a volume control knob mounted below the microphone; said megaphone comprising a top handle connecting from the body of the megaphone to the tip of the horn and a bottom handle extending from the bottom of the megaphone, having a short length and a long length wherein the two lengths are connect to form about a 90 degree angle, and said remaining end of the short length is attached to the body of the megaphone, and said remaining end of the long length is attached to the tip of the horn.

DETAILED DESCRIPTION OF THE DRAWINGS

Figure 1:
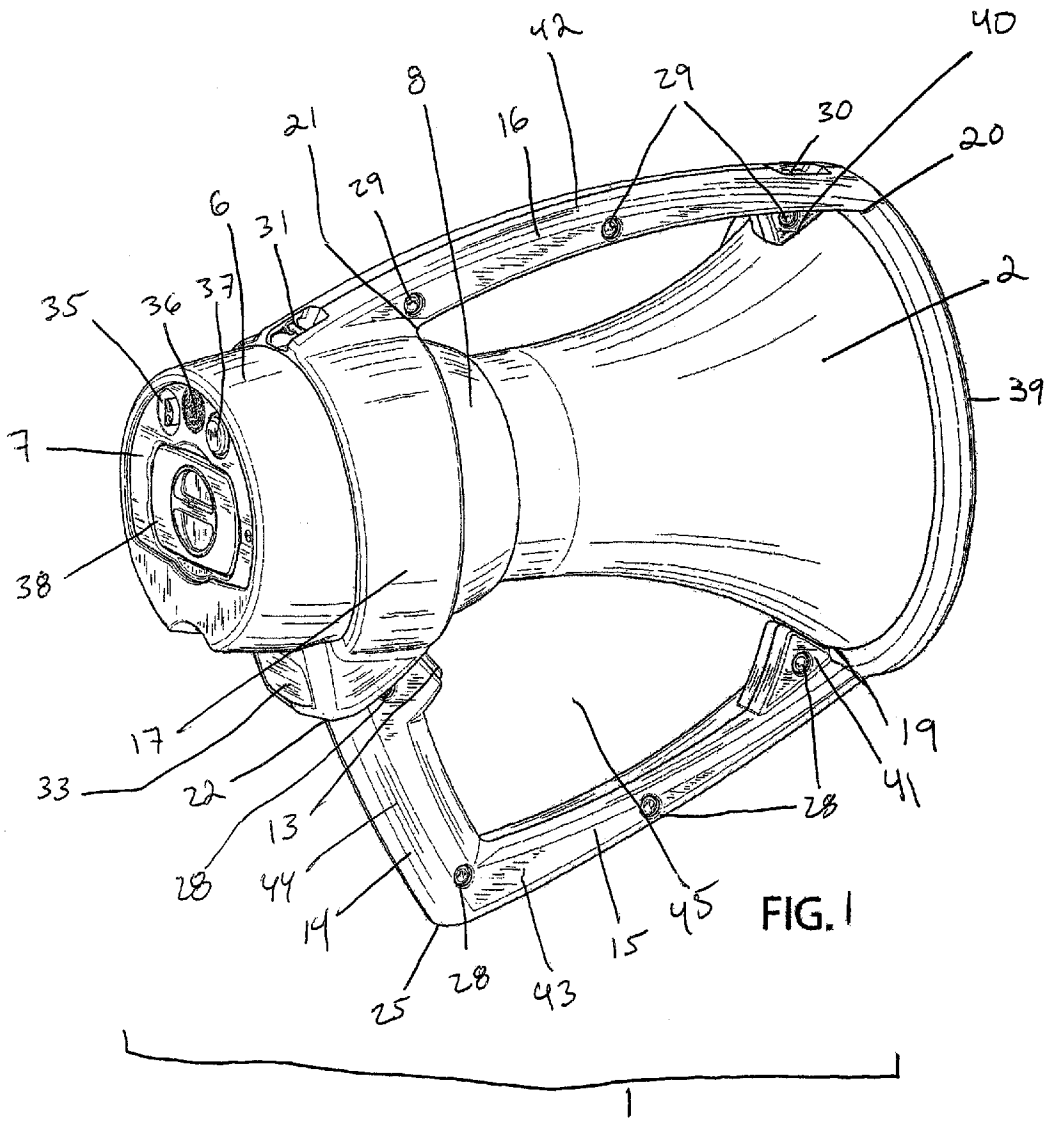
FIG. 1 identifies a perspective view of one embodiment of the invention described herein from the rear right side of the embodiment.

The embodiments of the invention and the various features and advantages thereto are more fully explained with references to the non-limiting embodiments and examples that are described and set forth in the following descriptions of those examples. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims.

As used herein, terms such as "a," "an," and "the" include singular and plural referents unless the context clearly demands otherwise.

As used herein, the term "about" means within 10% of a stated length.

The megaphone 1 as described herein is intended to function as a typical megaphone, utilizing a battery 38 to power the unit, and can be turned on or off through the use of a switch 37. When in the on position, the microphone 36 is activated through the use of the trigger 13, which utilizes an amplifier and a speaker to project the sound waves from the microphone 36 through the horn.

FIG. 1 identifies a rugged megaphone 1. Features of the megaphone 1 including the outer horn 2, a top handle 42, and a lower handle 43. The top handle 42 is connected to the outer horn 2, via the rim bumper 39, at the front end, and is connected to the body 7 and body handle 17 at the rear. The top handle 42 includes a top horn support 40 and a bottom horn support 41, situated at the front of the outer horn 2.

The megaphone described herein adds a top handle 42, a bottom handle 43, and a rim bumper 39 to add strength and durability to the megaphone 1 absent from a typical megaphone. Where a drop would frequently break the horn portion of the megaphone, having the top handle 42, the bottom handle 43, and the rim support 39, provides the strength and durability to allow the horn 2 to absorb impacts, such as a fall from about 4 or 5 feet to a grass or concrete surface, without breakage.

The top handle 42 and bottom handle 43, in addition to the body handles 12 and 17 are made of a plastic material. The plastic material possesses sufficient rigidity to support the weight of the megaphone, but also provides cushioning to the megaphone 1, should the megaphone 1 be dropped or thrown. As compared to a megaphone consisting of only a grip, the two handled megaphone provides additional strength and structure to the horn 2, which is a feature that commonly breaks on prior art megaphones during typical use. Thus, the handles provide enhanced durability for the megaphone.

Additionally, the two handles provide for enhanced convenience and comfort, allowing the user to hold the megaphone from above or below, using two hands or one. The top handle 42 and bottom handle 43 also provide a more convenient way to carry the megaphone when not in use.

Further, another aspect of prior art megaphones that break is the rear portions, including the microphone 36, the body 7, and the can 8. The prior art products are typically a plastic material that is rigid and cracks when a force is applied to it. The bumper 6 and the body handles 12 and 17 provide further support and structure to aid in absorption of such forces to these features.

The top handle 42 and bottom handle 43, each comprising a left and right part, are secured together via threaded fasteners 28 and 29. Other forms of attachment including rivets, or other mechanical fasteners, or various mechanical or chemical adhesives are also suitable for joining the two halves. The top handle 42 further comprises a front pin 30 and a rear pin 31, to allow for attachment of a strap and the bottom handle comprises a pin 32, for a third attachment point.

The outer horn 2 is attached to the front can 8, which is part of the body 7 of the megaphone. Within the body 7 of the megaphone further includes a plug 35, a microphone 36, an on/off switch 37, a battery pack 38, an amplifier, and other necessary electronic elements for the amplification of sound as known to one of ordinary skill in the art. Encircling the body 7, between the bumper 6 and the front can 8 is the body handle. The right body handle 17 connects the top handle 42 and bottom handle 43 to provide support for the megaphone 1. An opposing left body handle 12 (FIG. 2) connects to the right body handle 17 forming a complete body handle that encircles the body 7. Below the body 7 includes the base label 33 and the trigger 13, which activates the megaphone, when in the on position.

The bottom handle 43 includes a grip 44 portion of the handle. The grip 44 extends from the body 7 and is secured to the body at contact point 22. Unlike typical megaphones which comprise the grip 44 portion only, the megaphone of the invention described herein comprises a top handle 42 and a bottom handle 43, that extend from the body 7 to the front of the outer horn 2.

The bottom handle comprises a short length and a long length, where the two lengths are attached together at about a 90 degree angle resulting in an "L" shape. The short length is attached to the body 7 and comprises the grip 44, and the trigger 13, wherein the long length attaches to the front of the outer horn 2, and comprises the length 15. The short length or grip 44 portion is of sufficient length to allow a user to grab the megaphone 1 and pull the trigger with one or more finger. The grip 44 is about 50 mm to about 250 mm in length, or more particularly about 75 mm to about 150 mm in length, sufficient for a hand to fit on the grip 44. The bottom handle long length 15 is about perpendicular or attached at about a 90 degree angle to the short length 44, and extends from the bottom of the grip 44 to the top of the horn. However, other angles of at least about 45 to 135 degrees may be suitable. The long length 15 is about 1 time to about 5 times the length of the grip 44, or more particularly about 1.5 times to about 3 times the length of the grip 44. This provides an unobtrusive support structure and provides for an open space 45, between the bottom handle 43 and the horn 2, which can be utilized for holding or carrying the megaphone 1. The bottom handle 43 is intended to provide an opening between the bottom handle 43 and the outer horn 2, said space defining the bottom handle opening 45, where the bottom handle opening 45 is of sufficient size to allow a user to insert their hand and arm, so that the bottom handle opening 45 may serve as a mechanism to carry the megaphone 1 without the need for an additional strap.

Both the top handle 42 and the bottom handle 43 are attached to the rim bumper 39 at the top of the outer horn 2. The rim bumper 39 encircles the edge of the outer horn 2, providing additional stability and structural support to the outer horn 2. Further, the top handle 42 is attached to the outer horn 2 with a top horn support 40 and attached to the outer horn 2, and the lower handle 43 with the lower horn support 41. This is in addition to the connection of the top handle 42 and bottom handle 43 to the rim bumper at the contact points 19 and 20, respectively. Typically, the top handle and bottom handles are on opposing sides of the megaphone, situated about 180 degrees from one another.

The right body handle 17 and corresponding left body handle 12 (FIG. 2), provide additional strength, support, and protection to the body 7 of the megaphone 1. Further the bumper 6 also protects the body 7 from damage. The bumper 6 fits over the body 7 of the megaphone 1 providing additional support to the body 7. Together, the top handle 42, bottom handle 43, the body handles 12 and 17, the rim bumper 39, and the bumper 6, provide an "armor" that provides additional strength and durability to the underlying megaphone.

The top, bottom, and body handles may also be made of a rubber based material, or a resin based material, metals, plastics, foam, or combinations of these materials. The rim bumper 39 and the bumper 6 are made of a plastic material like the handles. Similarly, the bumpers 39 and 6 may also be made of a rubber based material, or a resin based material, metals, plastics, foam, or combinations of these materials.

The pins 30, 31, and 32 are made of a suitably rigid material, such as plastic or metal. Each pin feature is an opening in the top 42 or bottom handles 43 with a rod situated to be parallel to the threaded fasteners 28 and 29, and allowing said rod situated in the pins to serve as an attachment point, such as a hook or other latching device. The top pins 30 and 31, allow attachment of any number of carrying devices, such as a shoulder cord or a hand cord. The two attachment points on the top handle 42, allow creating of a loop to allow carrying of the megaphone 1 over the shoulder or in other manners. Contrastingly, the bottom pin 32, is a single pin, and provides a single attachment point. A user may attach a cord to any combination of pins, i.e. from pin 30 to pin 32, to pin 30 to pin 31, or to pin 32 to pin 30. Additionally, the pins may be used independently, with a carrying device that requires only a single contact point.

Figure 2:
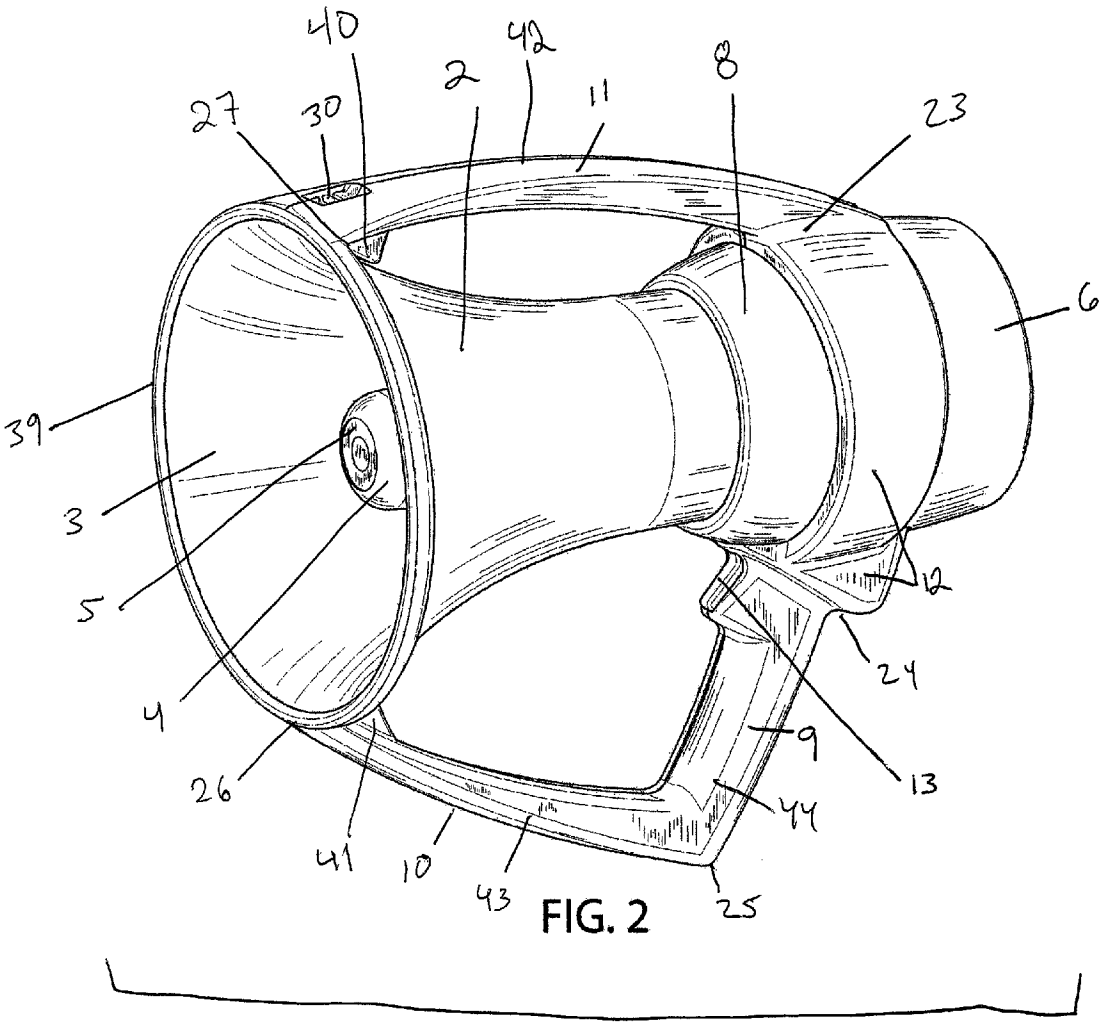
FIG. 2 identifies a perspective view of one embodiment of the invention described herein from the front left perspective.

FIG. 2 identifies the megaphone 1 of the invention described herein from the front left perspective. By showing the front of the megaphone 1, the inside horn 3 can be seen. Accordingly, the center horn 4 and the center horn label 5 can be seen from the drawing. The center horn is the speaker or output portion of the device, whereas the outer horn 2 aids in focusing and projecting the sound. The left portion of the megaphone 1 is nearly identical to the right portion. However, many of the features comprise a matching left and right sides, to allow these features to be secured to the megaphone 1. Typically the left and right portions are mirror images of one another, except for mechanisms to secure the two portions together.

FIG. 2 identifies the megaphone 1; comprising the top handle 42 and the bottom handle 43. In opposition to FIG. 1, FIG. 2 identifies the left side of opposing pairs of features, such as the top left handle 11, the left grip 9, the left bottom handle 10 and the left body handle 12. The top handle 43 is secured to the bumper rim 39 and to the top horn support 40 at the front of the megaphone 1, and is secured to the left body handle 12, on the left side of the megaphone 1, at the left handle contact point 23. The bottom handle, conversely, is attached to the bumper rim 39 and the bottom horn support 41, and the grip portion of the bottom handle 43, is attached to the left body handle 12 at the left handle contact point 24.

Figure 3:
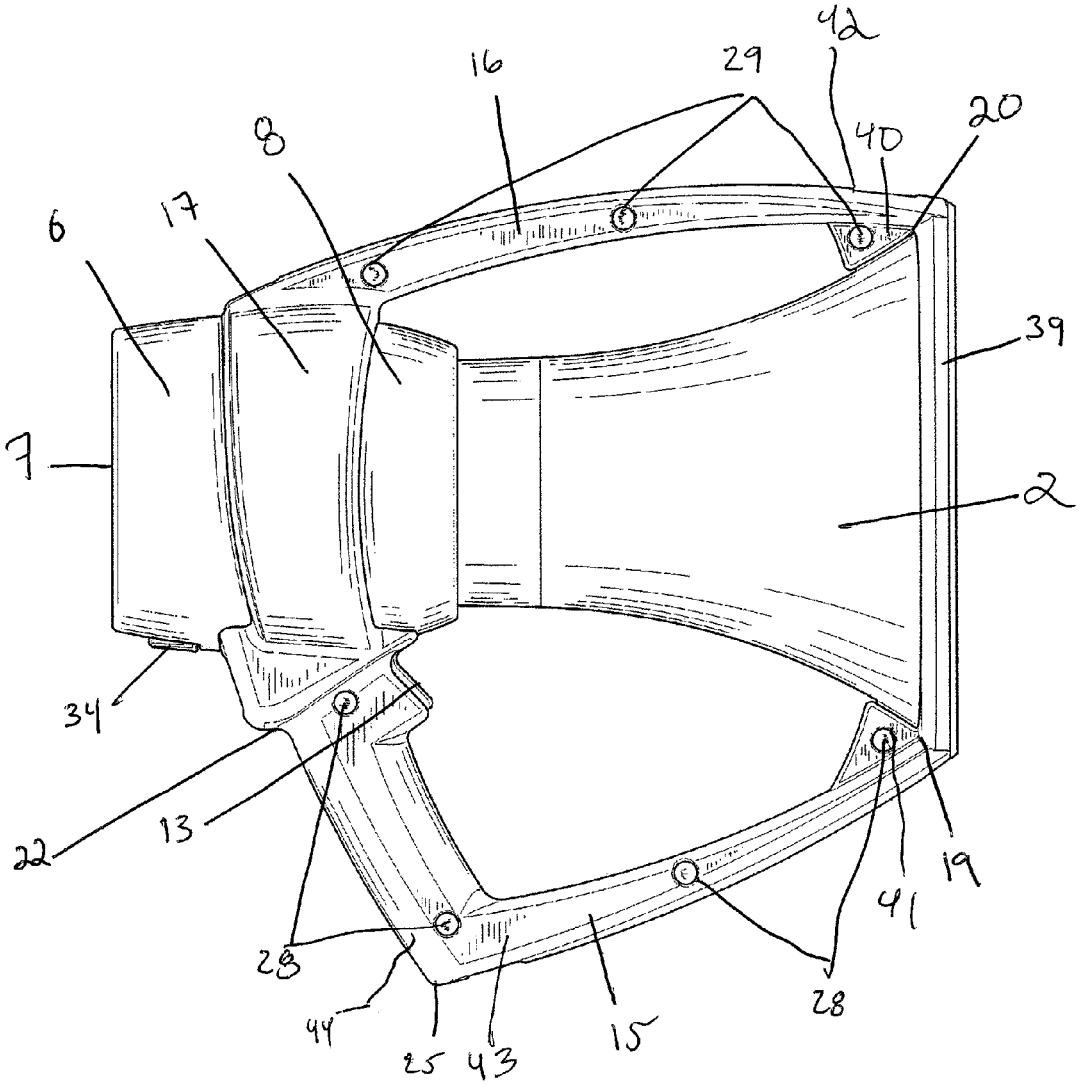
FIG. 3 identifies a perspective view of one embodiment of the invention described herein from the right side.

FIG. 3 identifies the right side of the megaphone 1. In this embodiment, the features are included in a single molded material, comprising a corresponding mirror image on the left side, such that the two pieces surround the body 7 and the outer horn 2, and provide the necessary structural support for the invention. In particular, the right bottom handle 15, the right body handle 17, the right top handle 16, and one half of the rim bumper 39 are a single molded piece of plastic. Additional features, such as the top and bottom horn supports are also secured to the single molded piece. The top threaded fasteners 20 and the bottom threaded fasteners 28, allow connection of the right portion to the corresponding mirror image left side. The bumper 6 additionally surrounds the body 7, and the front can, to provide structure, strength, and rigidity to the rear portion of the megaphone 1.

Additionally depicted in FIG. 3 is the knob 34, allowing adjustment of the volume of the megaphone 1, as well as the right handle contact point 22, which is the point where the grip 44 connects to the body 7.

Figure 4:
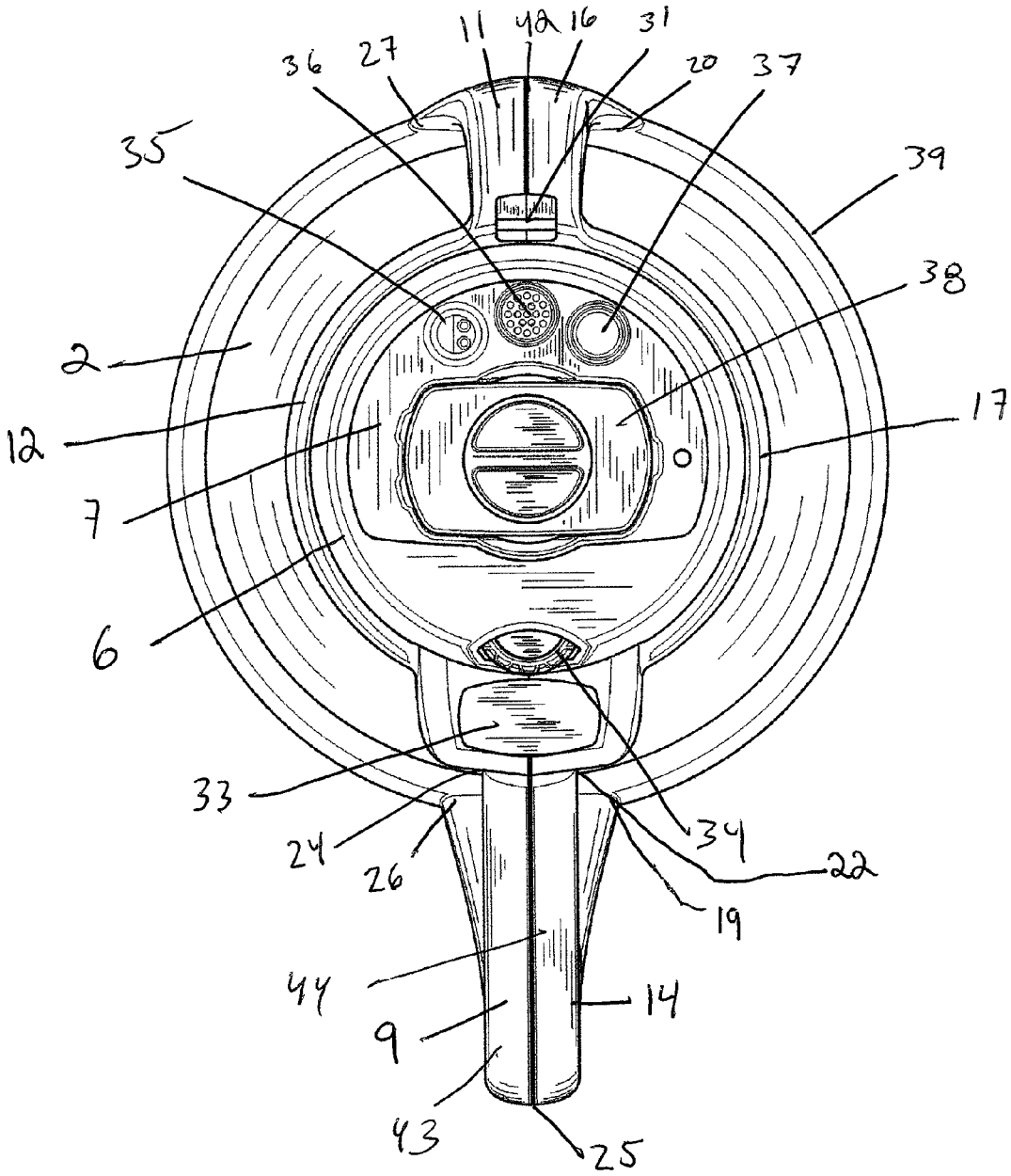
FIG. 4 identifies a perspective view of one embodiment of the invention described herein from the rear perspective.

FIG. 4 depicts the megaphone 1 of the invention described herein from the rear view. The rear view shows the division of the left and right hand features. The outer horn 2 is shown being surrounded at the front by the rim bumper 39. The rim bumper 39, surrounds the front rim of the outer horn, and then connects to the top handle 42 and the bottom handle 43 to provide the necessary strength and support to the outer horn 2. The top handle 42 has a left side 11 and a right side 16, and the rear portion of the top handle 42 has a rear pin 31 feature. Surrounding the body 7 of the megaphone 1 is the left body handle 12, and the right body handle 17. These handles provide the necessary strength and protection to the body 7 of the megaphone. The bumper 6, also surrounds the body 7, and adds more protection over the electronics situated inside the body 7. In particular, the body 7 houses a plug 35, a microphone 36, and an on/off switch 37. The megaphone 1 is powered by a removable and rechargeable battery 38. Below the battery 38 is the knob for adjustment of the volume. Below the knob 34 is the product label 33. Below the label 33 the grip 44 portion of the bottom handle 43 can be seen. There is a left handle grip 9 and a right handle grip 14. The grip 44 then connects to the rest of the bottom handle 43 at about a 90 degree angle at feature 25. Various contact points on the left 24 and 26 are shown, where the bottom handle 43 meets the rim bumper at point 26, and where the left handle grip 9 meets the left body handle 12. Similarly, the same features are provided at points 22 and 19 on the right side.

The invention herein recognizes that the bumpers and handles making up the layer of protection to the underlying megaphone may have left and right portions, such that they could be attached around a previously manufactured megaphone. This provides that a kit may be suitable, having a top handle, bottom handle, body handle, and bumper that can be attached to a previously manufactured microphone. Similarly, the left and right portions may be multiple pieces, and attached piecewise. Finally, a new megaphone 1 may be manufactured where the handles are integrated into the body of the megaphone, and some features then added to the integrated body, when made of a different material. In each situation, the result is a megaphone comprising a top 42 and bottom handle 43 and bumpers around the body 7 and the rim bumper 39 to provide support and strength to the megaphone design.

Figure 5:
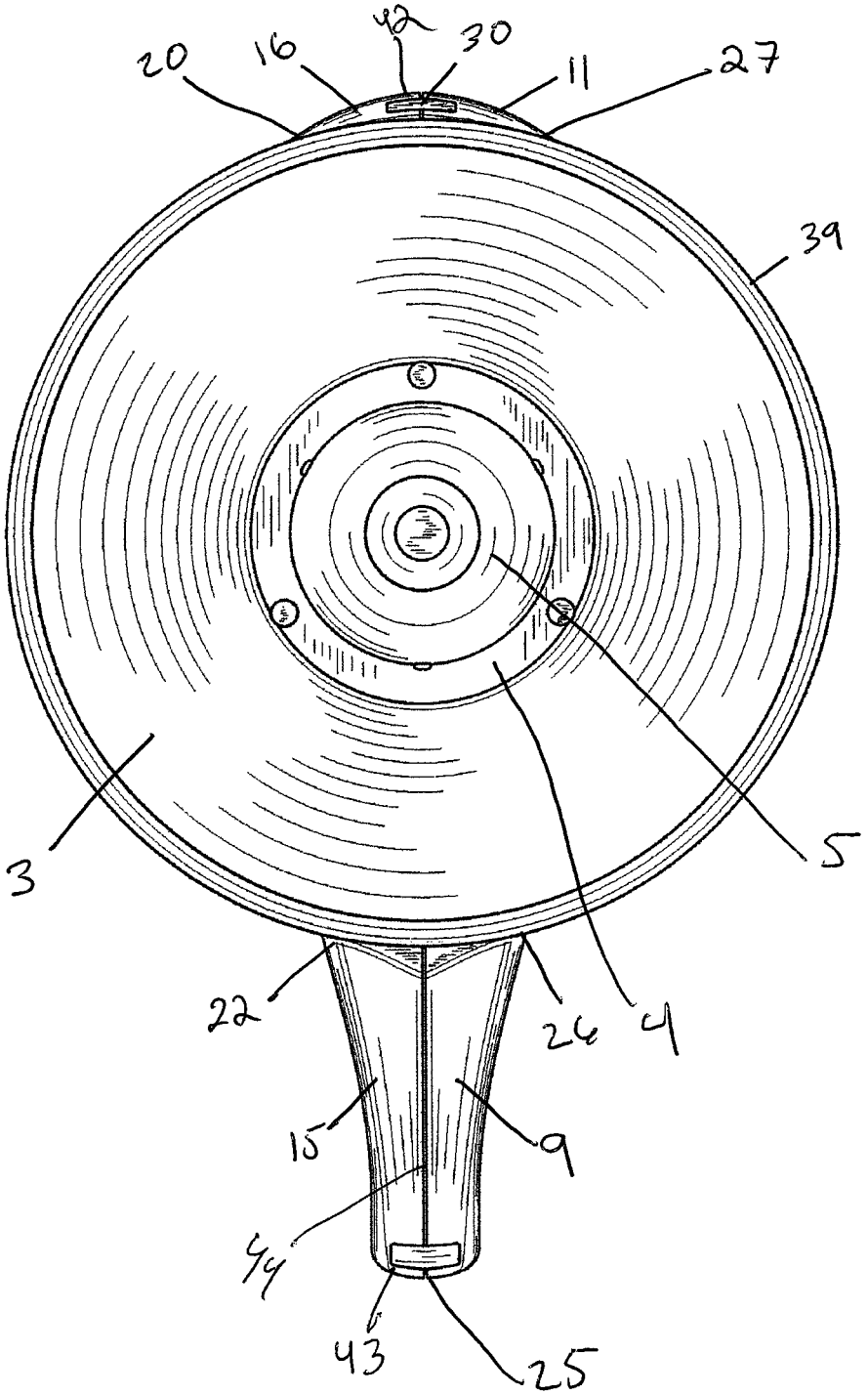
FIG. 5 identifies a perspective view of one embodiment of the invention described herein from the front perspective.

FIG. 5 identifies the invention described herein from the front view of the megaphone 1. The inner portion of the horn 3 can be seen, as well as the middle horn 4, and the middle horn label 5. The rim bumper 39 is a shown surrounding the edge of the outer horn 3. The rim bumper 39 covers the end of the outer horn, and extends onto a small portion of both the inside and outside of the outer horn 2. This allows the rim bumper to hold the front of the outer horn 2 stable. Further, the left and right portions of the top handle 42 and bottom handle 43 can be seen.

Figure 6:
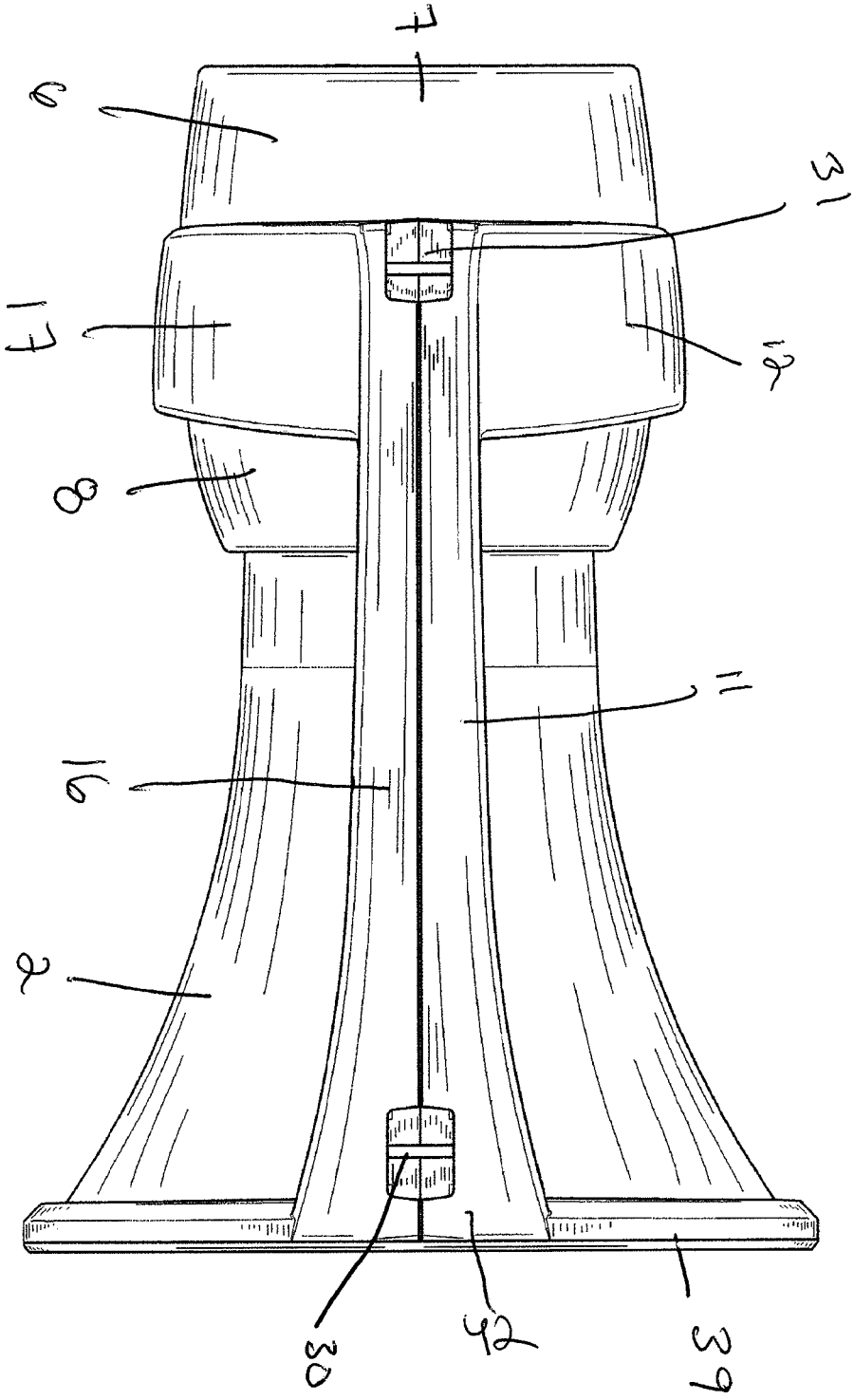
FIG. 6 identifies a perspective view of one embodiment of the invention described herein from the top perspective.

FIG. 6 identifies the invention described herein from the top of the megaphone 1. Accordingly, the figure is looking down on the top handle 42. The left top handle 11 and the right top handle 16 are shown attached to the rim bumper 39. Additionally, the rim bumper 39 is shown attached to the rim of the horn. The rim bumper 39 fits over the edge of the horn and extends down over the inside and outside of the horn for about 1 mm to about 20 mm, or more particularly about 5 mm to about 15 mm and encircles the rim of the horn. This extension aids in securing the rim bumper 39 to the horn rim. Additionally, the rim bumper 39 may be secured to the rim via an adhesive, or mechanical attachment. The left body handle 12 and the right body handle 17 are shown surrounding the body 7, and include the bumper 6, and the front can 8, that are surrounded by the body handles. Also situated on the top handle 42 are the front 30 and rear 31 pins.

Figure 7:
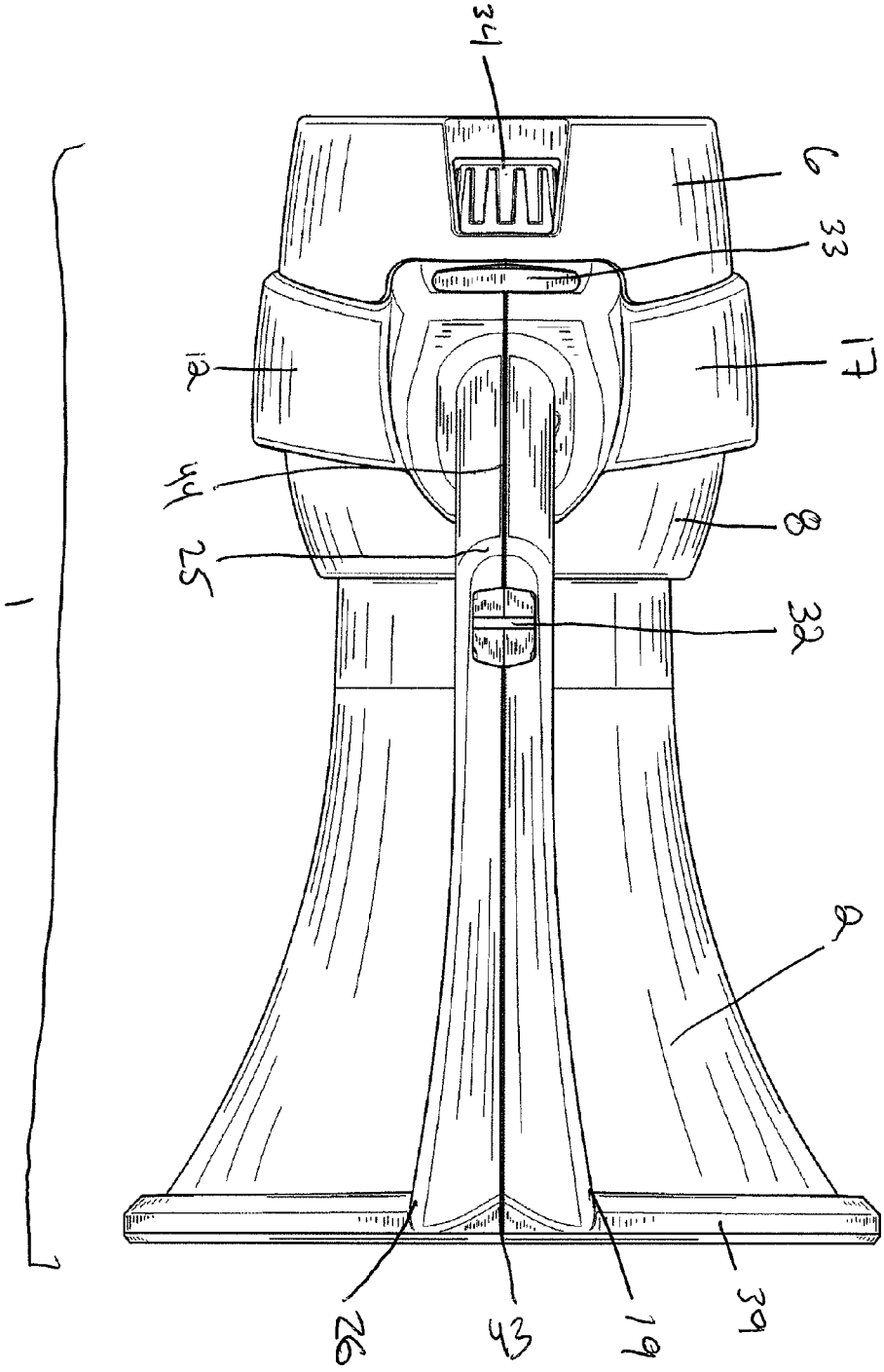
FIG. 7 identifies a perspective view of one embodiment of the invention described herein from the bottom perspective.

FIG. 7 identifies the invention from the bottom, looking down on the bottom handle 43. The rim bumper 39 is shown surrounding the portion of the outer horn 2. The bottom handle 43 then attaches to the rim bumper 39 at the front of the megaphone 1, and attaches to the left and right body handles 12 and 17 near the rear of the megaphone. This provides a bottom handle 43 that supports the outer horn 2. Further, the positioning of the knob 34 is shown, as well as the bottom pin 32 and the label 33.

EXAMPLES

The megaphone of the invention described herein was tested against two other megaphones for mechanical and functional strength when subjected to a drop test. The purpose of the tests were to determine whether the megaphone as described in this invention was superior in durability as compared to megaphones in the prior art and a megaphone having only some additional armor.

The following tables present the results of drop tests of the megaphone. Table 1 displays the results of the drop test for the megaphone described herein. Table 2 displays the results of the drop test for a megaphone with the top handle 42 and bottom handle 43 removed. Table 3 displays the results of the drop test for a megaphone with the top handle 42, bottom handle 43, and rim bumper 39 removed. In all tests, the drop testing procedure includes pressing the surfaces and edges of the megaphone for 15 minutes at 100 psi. Once the result for a given surface or edge of the megaphone is recorded, the test proceeds and the same megaphone is pressured on a different surface or edge. "Pass" indicates that after the drop (1) megaphone still functioned correctly and (2) there were no substantive mechanical flaws such as broken screws. Minor mechanical flaws such as chipped plastic are not considered substantive and thus do not count as a "failure."

TABLE 1

| Drop # | Face or Edge Tested | Result |
|---|---|---|
| 1 | Edge between top handle 42 and rim bumper 39. | Pass |
| 2 | Edge on right side of rim bumper 39 as oriented in FIG. 2. | Pass |
| 3 | Edge between bottom handle 43 and rim bumper 39. | Pass |
| 4 | Edge on left side of rim bumper 39 as oriented in FIG. 2. | Pass |
| 5 | Edge on the middle of bottom handle 43. | Pass |
| 6 | Edge at 90 degree angle 25 on bottom handle 43. | Pass |
| 7 | Edge on the middle of top handle 42. | Pass |
| 8 | Edge on back of bottom handle 43. | Pass |
| 9 | Edge on top of bumper 6. | Pass |
| 10 | Edge on right side of bumper 6 as oriented in FIG. 1. | Pass |
| 11 | Edge on bottom of bumper 6. | Pass |
| 12 | Edge on left side of bumper 6 as oriented in FIG. 1. | Pass |
| 13 | Edge on side of megaphone displayed in FIG. 2. | Pass |
| 14 | Edge on side of megaphone displayed in FIG. 1. | Pass |
| 15 | Front face of megaphone displayed in FIG. 5. | Pass |
| 16 | Back face of megaphone displayed in FIG. 6. | Pass |

An embodiment of the invention described herein passed all 16 steps of the drop test without any functional error or substantive mechanical flaws. It experienced only minor damage, such as chipped paint, damage to an end bumper, and lost dowel pins.

TABLE 2

| Drop # | Face or Edge Tested | Result |
|---|---|---|
| 1 | Edge between top handle 42 and rim bumper 39. | Fail - Mechanical |
| 2 | Edge on right side of rim bumper 39 as oriented in FIG. 2. | Fail - Mechanical |
| 3 | Edge between bottom handle 43 and rim bumper 39. | Fail - Mechanical |
| 4 | Edge on left side of rim bumper 39 as oriented in FIG. 2. | Fail - Mechanical |
| 5 | Edge on the middle of bottom handle 43. | Fail - Mechanical |
| 6 | Edge at 90 degree angle 25 on bottom handle 43. | Fail - Mechanical |
| 7 | Edge on the middle of top handle 42. | Fail - Mechanical |

TABLE 2-continued

| Drop # | Face or Edge Tested | Result |
|---|---|---|
| 8 | Edge on back of bottom handle 43. | Fail - Mechanical |
| 9 | Edge on top of bumper 6. | Fail - Mechanical |
| 10 | Edge on right side of bumper 6 as oriented in FIG. 1. | Fail - Mechanical |
| 11 | Edge on bottom of bumper 6. | Fail - Mechanical |
| 12 | Edge on left side of bumper 6 as oriented in FIG. 1. | Fail - Mechanical |
| 13 | Edge on side of megaphone displayed in FIG. 2. | Fail - Mechanical |
| 14 | Edge on side of megaphone displayed in FIG. 1. | Fail - Mechanical |
| 15 | Front face of megaphone displayed in FIG. 5. | Fail - Mechanical |
| 16 | Back face of megaphone displayed in FIG. 6. | Fail - Mechanical |

The megaphone in Table 2 had a rim bumper, but no top or bottom handles. This megaphone functioned throughout the test, but had a major mechanical failure on the first drop. Specifically, the top of the horn broke when pressure was applied to it. Similarly, the middle of the horn broke when pressure was applied to it on the second drop.

TABLE 3

| Drop # | Face or Edge Tested | Result |
|---|---|---|
| 1 | Edge between top handle 42 and rim bumper 39. | Pass |
| 2 | Edge on left side of bumper 6 as oriented in FIG. 1. | Pass |
| 3 | Edge on right side of rim bumper 39 as oriented in FIG. 2. | Pass |
| 4 | Edge between bottom handle 43 and rim bumper 39. | Fail - Mechanical |
| 5 | Edge on side of megaphone displayed in FIG. 1. | Fail - Functional and Mechanical |
| 6 | Edge on left side of rim bumper 39 as oriented in FIG. 2. | Fail - Functional and Mechanical |
| 7 | Edge at 90 degree angle 25 on bottom handle 43. | Fail - Functional and Mechanical |

The megaphone in table 3 had no rim bumper and no top or bottom handles. It is more representative of the prior art. In this test, the middle of the horn broke in drop 4. Additionally, the megaphone stopped functioning after drop 5.

In sum, the megaphone of the invention described herein, and depicted in Table 1, passed all stress tests. The megaphone from Table 2, having no top or bottom handles failed all stress tests. Finally, the megaphone from Table 3, having no top or bottom handle and no rim bumper, failed the majority of stress tests.

The invention now being fully described it will be apparent to one of ordinary skill in the art that many changes and modifications can be made thereto without departing from the spirit or scope of the appended claims.

What is claimed is:

1. A rugged megaphone comprising:

a. A megaphone comprising a body, a horn, and a microphone; wherein said horn is attached to one end of the body and said microphone is attached to the opposite end of the body from the horn, b. a rugged casing comprising a body handle, a top handle, a bottom handle, and a rim bumper; wherein the body handle encircles the body of the megaphone and the rim bumper encircles the tip of the horn; wherein the top handle is situated on the top of the megaphone and connects from the body handle to the rim bumper and wherein the bottom handle is situated on the bottom of the body, connecting from the bottom of the grip to the rim bumper.

2. A rugged megaphone of claim 1 wherein the rugged casing comprises a left side and a right side, wherein each of the left and right sides comprises one half of the body handle, the top handle, the bottom handle, and the rim bumper; wherein the left and right sides are a paired set, capable of being attached together.

3. A rugged megaphone of claim 1 wherein the rugged casing comprises a left side and a right side, wherein each of the left and right sides comprises one half of the body handle, the top handle, the bottom handle, and the rim bumper; wherein the left and right sides are a paired set, each side being a mirror image of the other, capable of being attached together.

4. The rugged megaphone of claim 1 wherein the handle has a short length and a long length, and the two lengths are attached at one end at an angle between 45-135 degrees, wherein the short length is attached to the body of the megaphone, and the long length is attached to the rim of the horn.

5. The rugged megaphone of claim 1 wherein the bottom handle has a short length and a long length, and the two lengths are attached at one end at about a 90 degree angle, wherein the short length is attached to the body of the megaphone, and the long length is attached to the rim of the horn.

6. A rugged megaphone covering kit comprising:

a. a megaphone and a kit b. wherein said kit comprises a bumper selected to fit over the body of the megaphone, a left structure and a right structure; said left and right structures being a complementary pair, with each structure comprising a top handle and a bottom handle, a body handle, and a rim bumper, said left and right structures being of such fit to surrounding the outer rim of the horn, the handle, and the body, and said left and right structures being capable of being secured together to securely fit around said megaphone.

7. The rugged megaphone covering kit of claim 6 wherein said left structure and said right structure are mirror images of the other.

8. The rugged megaphone covering kit of claim 6 wherein the bottom handle has a short length and a long length and the two lengths are attached at one end at about an angle between 45-135 degrees, wherein the short length is attached to the body of the megaphone, and the long length is attached to the rim of the horn.

9. The rugged megaphone covering kit of claim 6 wherein the bottom handle has a short length and a long length and the two lengths are attached at one end at about a 90 degree angle, wherein the short length is attached to the body of the megaphone, and the long length is attached to the rim of the horn.

10. A megaphone comprising:

a. a megaphone body; a horn secured to one end of said body; a microphone secured to the other end of said body; an amplifier situated within the body of the megaphone capable of amplifying sound waves directed at the microphone; a speaker capable of projecting sound waves; and a battery secured to the microphone end of the body to power the microphone, amplifier, and speaker;

b. a power switch and a trigger, wherein the power switch can turn the megaphone on or off and the trigger can activate the microphone when the megaphone is turned on;

c. a volume control knob mounted below the microphone;

d. a rugged casing comprising a body handle, a top handle, a bottom handle, and a rim bumper;

wherein the body handle encircles the body of the megaphone and the rim bumper encircles the tip of the horn; and wherein a top handle connecting from the body of the megaphone to the tip of the horn; a bottom handle on the opposing side from said top handle, extending from the bottom of the megaphone, in the shape of a grip handle extending about 5 inches from the body, and thereafter curved at about 60-90 degrees and attaching to the tip of the horn.

11. The megaphone of claim 10 wherein the bottom handle is curved at an angle between 45-135 degrees.

12. The megaphone of claim 10 wherein the bottom handle is curved at about 90 degrees.

13. The megaphone of claim 10 wherein said top handle and said bottom handle are manufactured in at least two pieces.

14. The megaphone of claim 10 wherein said top handle and said bottom handle are manufacture in a single piece.

* * * * *